United States Patent [19]

Sundquist

[11] 3,936,776

[45] Feb. 3, 1976

[54] INTERSPERSED DOUBLE WINDING HELICAL RESONATOR WITH CONNECTIONS TO CAVITY

[75] Inventor: John Robert Sundquist, Melrose, Mass.

[73] Assignee: Bell Telephone Laboratories, Incorporated, Murray Hill, N.J.

[22] Filed: Mar. 10, 1975

[21] Appl. No.: 556,565

[52] U.S. Cl. ..... 333/73 R; 333/73 C; 333/82 B

[51] Int. Cl.[2] ..... H01P 1/20; H01P 7/04

[58] Field of Search ... 333/73 R, 73 C, 73 W, 82 R, 333/82 B

[56] References Cited

UNITED STATES PATENTS

| | | | |
|---|---|---|---|
| 2,700,129 | 1/1955 | Guanella | 323/83 |
| 2,826,698 | 3/1958 | Mason | 334/45 |
| 3,090,920 | 5/1963 | Levine | 325/468 |
| 3,538,463 | 11/1970 | Pakan | 333/73 R |
| 3,763,447 | 10/1973 | Takahashi et al. | 333/73 R |

FOREIGN PATENTS OR APPLICATIONS

| | | | |
|---|---|---|---|
| 30,862 | 9/1971 | Japan | 333/73 R |

OTHER PUBLICATIONS

Zverev, Handbook of Filter Synthesis, John Wiley & Sons, Inc., N.Y., 1967, pp. 499–521.

IEE (Britain) Colloquim Digest No. 1973/6, New Developments in UHF Helical Filters, Lind et al.

Lind et al., Generalised Interdigital Helical Filter, Electronics Letters, Oct. 19, 1972, Vol. 8, No. 21, pp. 525, 526.

*Primary Examiner*—Paul L. Gensler
*Attorney, Agent, or Firm*—Wilford L. Wisner

[57] ABSTRACT

In a helical resonator, sometimes called a coaxial resonator with helical inner conductor, new capabilities are achieved by providing a double winding with the turns interspersed and of like pitch. One pair of respective opposite ends of the two portions of the double winding is connected directly to the cavity or ground conductor of the resonator, sometimes called the shield. Coupling to the cavity is achieved by any prior coupling technique. The new resonator can be included in compound helical resonator filters as would other helical resonators. One of the principal advantages of the new helical resonator is its ability to suppress odd harmonics both in its own resonator characteristic and in the characteristics of a composite filter in which it is only one of several helical resonators.

10 Claims, 14 Drawing Figures

INTERSPERSED DOUBLE WINDING HELICAL RESONATOR WITH CONNECTIONS TO CAVITY

BACKGROUND OF THE INVENTION

This invention relates to helical resonators and filter circuits employing helical resonators.

In some frequency ranges such as an extended range around 100 MHz, lumped-parameter filters may be objectionably lossy and perhaps too small to fabricate precisely for a particular application; yet, at the same time, it may not be desired to construct filters of waveguide-type configurations because they may be too bulky for the particular application or may not be otherwise compatible with the application environment intended.

The helical resonator, sometimes called a coaxial resonator with helical inner conductor, was developed to provide a solution to the High Q resonator problem in the frequency range in which both the pure lumped-parameter approach and the pure waveguide or distributed-parameter approach were for various reasons found to be awkward. It represents an intermediate type of solution having some aspects of a lumped parameter circuit and some aspects of a distributed parameter or guided-wave type of circuit. It has been found that helical resonators offer a practical solution to the need for filters of small percentage bandwidth, typically less than 2%, in the range from 30 MHz to 500 MHz.

A conventional helical resonator employs a single conducting helix mounted within a suitably proportioned outer conductor or conducting shield. One end of the helix is connected to the shield. The anti-resonant frequency is determined by the inductance and distributed capacitance existing in this coaxial cavity. Usually, additional reactance, such as trimming capacitance, is introduced for tuning purposes. Additional fundamentals on the technical aspects of helical resonators may be found in the book by A. I. Zverev, Handbook of Filter Synthesis, Wiley (1967) pages 499–507.

When a number of these helical resonators are cascaded to form a coupled-resonator bandpass filter, it is found that additional passbands occur in the vicinity of odd multiples of the fundamental anti-resonant frequency or center frequency of the desired passband. These undesired passbands are so pronounced in the simple cascaded resonator configuration that special treatment is required when continuous stopbands are needed. Furthermore, since the coupling between resonators is usually achieved by the use of side wall apertures that reduce the resonator Q it is desirable to be able to minimize the number of such coupling apertures in a cascaded filter. In other words, coupled-resonator filters having a desired passband and continuous adjacent stopbands are desired, but with a superior resonator Q.

More generally, the helical resonator filter art is a relatively new art in which a greater variety of circuit components and design techniques would be desirable. Indeed, modified components could facilitate advanced design techniques.

SUMMARY OF THE INVENTION

According to my invention, the foregoing objectives are achieved in a helical resonator filter by providing a helical inner conductor having two tightly-coupled portions of like pitch and interspersed turns, a pair of respective opposite ends of the two portions being connected directly to the shield or cavity of the individual resonator.

Advantageously, the new helical resonator can be cascaded in compound resonator filters, just as any prior helical resonator, but can supply a better characteristic for a given number of coupling apertures than if it were of the simpler prior art type.

A further advantage of the new helical resonator is that, in any of its applications, any prior art input and output coupling technique for a helical resonator can be used.

According to a subsidiary feature of the invention, the double winding helical resonator is used by cascading it with other more conventional helical resonators to suppress odd harmonics of the passband of the combination.

According to another subsidiary feature of my invention, like helix diameters are preferred for the respective portions of the double winding helical resonator.

BRIEF DESCRIPTION OF THE DRAWINGS

Further features and advantages of my invention will become apparent from the following detailed description taken together with the drawing in which.

DESCRIPTION OF ILLUSTRATIVE EMBODIMENTS

Figure 1A:
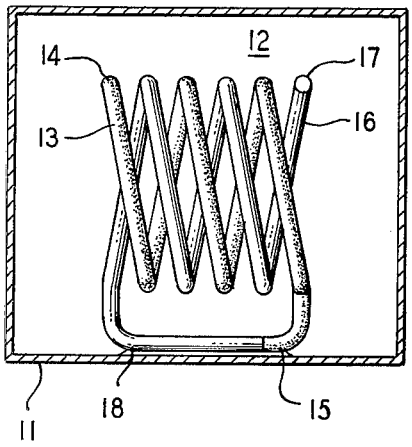
FIGS. 1A and 1B show two orthogonal elevations of a helical resonator according to my invention.
Figure 1B:
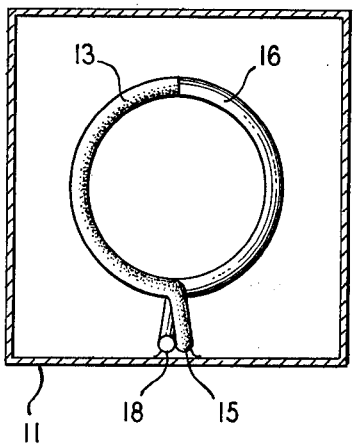

In the embodiments of FIG. 1A and FIG. 1B, the helical resonator shown includes the housing, specifically the shield 11, which forms the ground plane of the resonator and is the outer conductor with respect to the helical center conductor 12, which is a conductive coil consisting of two portions 13 and 16. Portion 13 starts at the free end point 14 and continues until it contacts shield 11 at point 15. The portion 16 starts at the free end 17 and continues until it contacts shield 11 at point 18. Thus, the conductive coil 12 can be said to consist of a bifilar winding 13, 16 the conductor of which is connected to the shield 11 at a pair of opposite ends of the respective portions with the remaining pair of ends being free or unconnected. The shield 11 and the portions 13 and 16 have the same general proportions as a conventional helical resonator of comparable Q.

The tightly coupled arrangement of the two helical portions 13 and 16 results in a relatively confined electric field as compared to prior helical resonators of comparable Q, and a magnetic field which is equally intense at either end. The distributed capacitances which determine the resonant frequency of the resonator are relatively high. Total conductor length of both portions 13 and 16 is about 0.15 wavelengths.

I submit as a working hypothesis, although I do not wish to limit my invention to this explanation, that the tight coupling between the two helical portions 13 and 16 contributes to uniformity in the direction of current flow within the helical center conductor, so that a number of higher order resonant modes are inhibited.

Regardless of whether the uniformity in the direction of current flow is the responsible factor, I have found that in fact a high insertion loss is obtained at odd harmonics of the fundamental frequencies in filters employing this resonator. In the structure I have made, an increase in insertion loss at the third and fifth harmonics has been measured.

Before continuing to more sophisticated configurations and the modes of operation of filters employing the new resonator, further optional details of the embodiment of FIGS. 1A and 1B may be mentioned. For convenience in supporting the structure, the conductors are continued from the initial points of contact 15 and 18 with shield 11 and are made to lie side by side as shown more clearly in FIG. 1B. Since coil forms may typically be used to support helical conductor 12, this feature is not necessary; and indeed alternatives are shown hereinafter. Furthermore, no input or output coupling techniques or means for trimming the resonant frequency are shown in FIGS. 1A and 1B because all of these coupling and trimming techniques are conventional in the art and are not inhibited from use with my invention.

Figure 2:
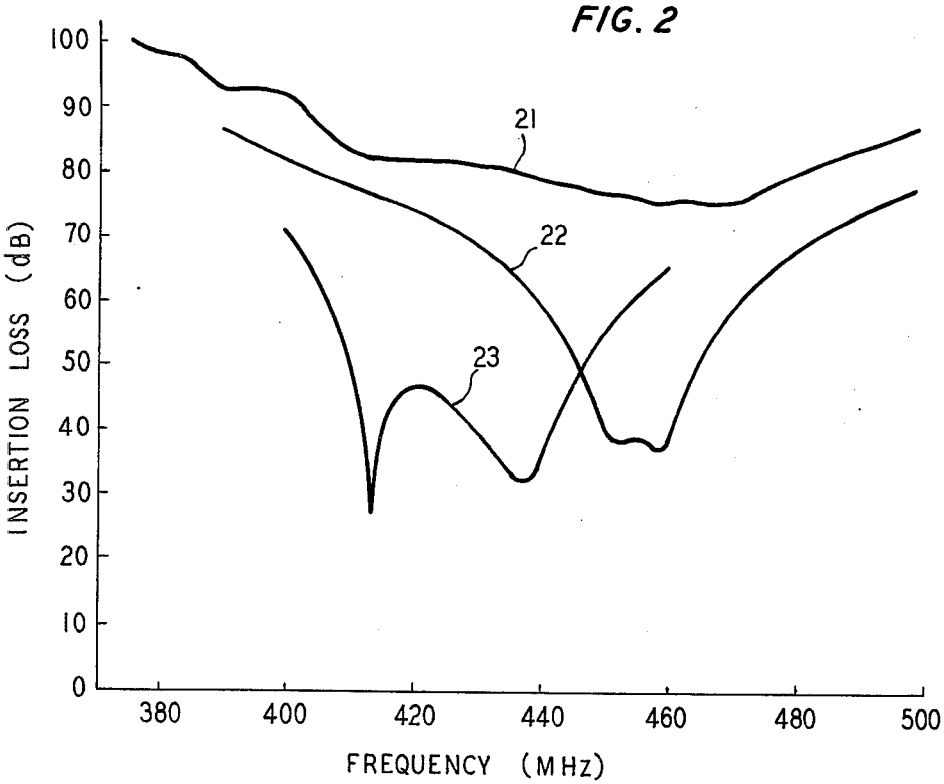
FIG. 2 shows curves which are illustrative of the improvement in harmonic insertion loss in compound resonator filters including the helical resonator of my invention.
Figure 3:
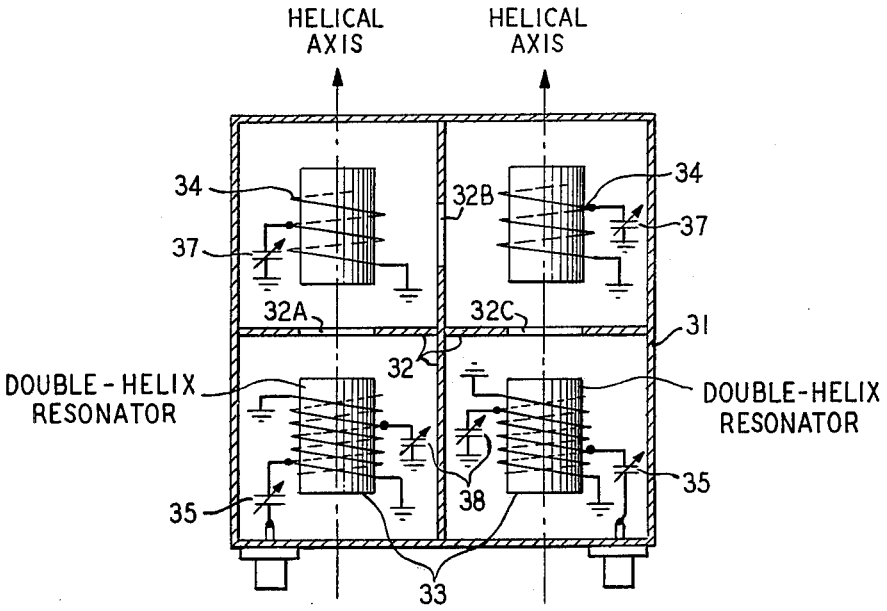
FIG. 3 shows an illustrative partially pictorial and partially schematic embodiment of a resonator-filter including four helical resonators, two of which are constructed according to my invention.
Figure 6:
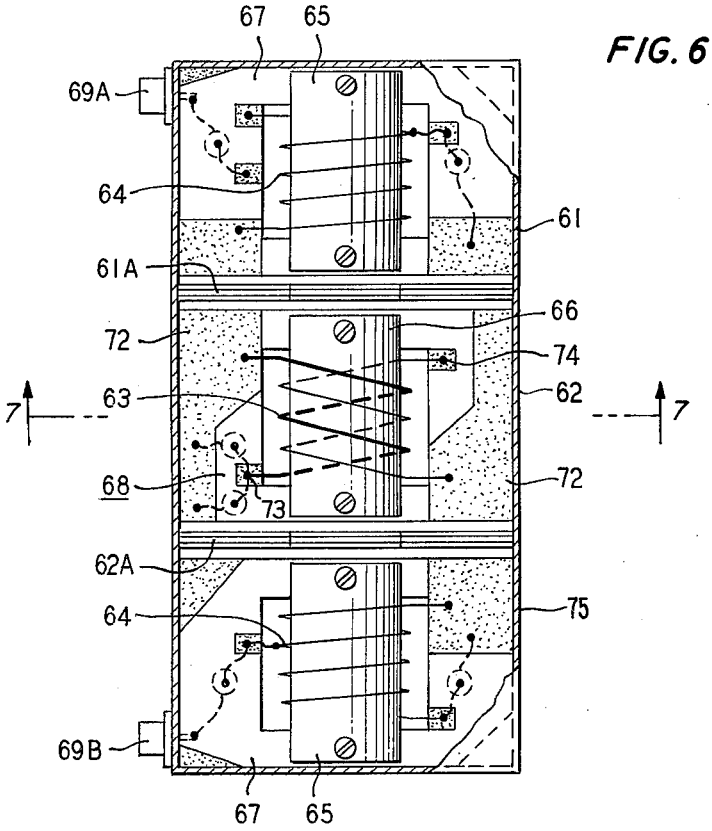
FIG. 6 shows an implementation of such a filter employing my double winding helical resonator as the center resonator.

The primary usefulness of my helical resonator so far demonstrated has been to suppress odd harmonics in composite resonator filters in which the helical resonators of FIGS. 1A and 1B are coupled with other more conventional helical resonators as shown in the alternative embodiments of FIGS. 3 and 6. Indeed, the insertion loss versus frequency curve 21 of FIG. 2 was measured for a composite resonator filter of the type shown in FIG. 6.

It is found that, when one or more of the new resonators are cascaded with single helical resonators or with each other along a single helix axis as shown in FIG. 6, a high coefficient of inductive coupling may be achieved. Thus, their use is not confined to narrow band filters; and an alternative to lumped-parameter filters may be possible in more applications than heretofore. Optionally, with an axial coupling arrangement, it is not necessary to use intermediate side walls with their attendant apertures and degradation of resonator Q. That is, a single housing 11 like that in FIGS. 1A and 1B may be used for the axially coupled helical conductors, rather than the individual shields 61, 62 and 63 including the intermediate side walls 61A and 62A of FIG. 6, even though the contrary arrangement is illustrated.

It has been found that a double helical resonator as in FIGS. 1A and 1B may be substituted for a single helical resonator in a prior art resonator filter or a number of them may be substituted for a number of coupled single helical resonators in some configurations, because of the superior characteristics.

In either case, the resonator may be tapped for connection of load and generator or matching networks according to conventional techniques some of which are shown hereinafter. Typically, taps may be made on either helix or on both of them.

An additional advantage of combining the double helical resonator with the single helical resonator of the prior art, as shown in FIGS. 3 and 6, is that the distinctly differing resonator designs avoid the convergence of unwanted responses. This is a general characteristic that may be broader than simply the suppression of odd harmonics. Indeed, it is often difficult to avoid convergence of unwanted responses in a composite filter when identical resonators are used.

This fact was recently demonstrated at a 140 MHz, three resonator bandpass filter in which one double winding helical resonator was used with two conventional helical resonators. Each of the latter conventional resonators had an unwanted response in the vicinity of 420 MHz. But because of the presence of the double winding helical resonator, the stopband insertion loss did not fall below 75 dB in the region of 420 MHz. This improved result was obtained in spite of the fact that input and output coupling was capacitance coupling, which is high pass in nature. That is, capacitance coupling was used for the connection of generator and load resistances, rather than the more conventional taps to the helix. Thus, the coupling was essentially like that shown in FIG. 3 with capacitors 35. But the end-to-end arrangement of helical conductors was essentially like that in FIG. 6.

The measured response curve is curve 21 of FIG. 2. The passband was centered at 140 MHz for this three resonator filter. The response is shown in the vicinity only of the 3rd harmonic to show that it is relatively flat. This flat response shown in curve 21 may be compared to those for multiple resonator compound filters using only conventional single helical resonators as shown in curves 22 and 23. Curve 22 is specifically for a 150 MHz four resonator filter. Although it was provided with load and generator coupling by inductive coils directly connected to taps on respective helices which are low pass in character, even this adaptation could not avoid the poor characteristic at the third harmonic, 450 MHz, which is shown by curve 22. Specifically, the insertion loss has fallen to the 40 dB level. For curve 23, a 150 MHz three resonator filter using three conventional laterally coupled helical resonators was tested. The load and generator were connected directly to taps on the end resonators in standard fashion. The insertion loss at the third harmonic is still at or below the 50 dB level and near 415 MHz and 440 MHz spurious responses were obtained in which the insertion loss was as low as 30 or 40 dB, respectively. In comparison the composite resonators using my double winding helical conductor achieves the comparatively flat response curve 21. For practical application, the characteristic of curve 21 is of tremendous advantage.

It should be understood that the characteristics of all three resonator filters that were tested for purposes of comparison were approximately comparable in the vicinity of their passbands, which are not shown in FIG. 2.

In the alternative embodiment of FIG. 3 one of several possible combinations and permutations employing the double winding helical resonator in a bandpass filter is illustrated. The shield 31 is formed into a four segment cavity having coupling apertures in three of the interior walls 32, the apertures being labelled 32A, 32B and 32C. The new double winding helical conductors 33 are positioned, for purposes of illustration, in the quadrants in which input and output coupling are achieved, illustratively, by the coupling capacitors 35. Each of these double winding helical resonators with the double winding conductors have capacitive coupling through coaxial connections through the lower portion of shield 31 and are internally coupled through respective apertures 32A and 32C to conventional helical resonators including the single winding helical conductors 34, the latter being coupled through the aperture 32B to one another laterally.

Figure 4:
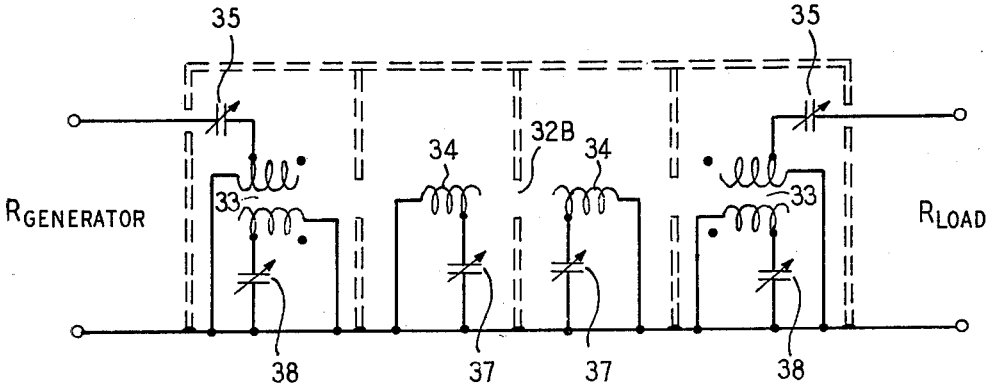
FIG. 4 shows a schematic illustration of the equivalent circuit of the filter of FIG. 3.

The equivalent circuit for the modified embodiment of FIG. 3 is shown in FIG. 4, and can be analyzed according to conventional techniques. The capacitors 37 and 38 are conventional trimming capacitors for purposes of tuning. In the equivalent circuit of FIG. 4, it should be noted that there is a mutual inductance which can be used to account for the coupling between the two portions of each of helical conductors 33 as well as mutual inductances between each of the single winding conductors 34 and the other helical conductors, which mutual inductance accounts for the coupling through the apertures 32A–32C. Alternatively, aperture 32B may be located closer to a position between the ungrounded ends of helical conductors 34 in which case the coupling through this aperture would be mainly capacitive in nature.

Another modified embodiment is shown in FIG. 6. For purposes of illustration, the double winding helical condutor 63 is placed as the center one of three helical center conductors within the compound shield 61, 62 and 75. Internal walls 61A and 62A are shown for purposes of illustration and include coupling apertures. Those internal walls and coupling apertures are not necessary; and, indeed, the degree of coupling can be controlled by the spacing between double winding helical conductor 63 and the more conventional helical conductor 64.

Figure 5:
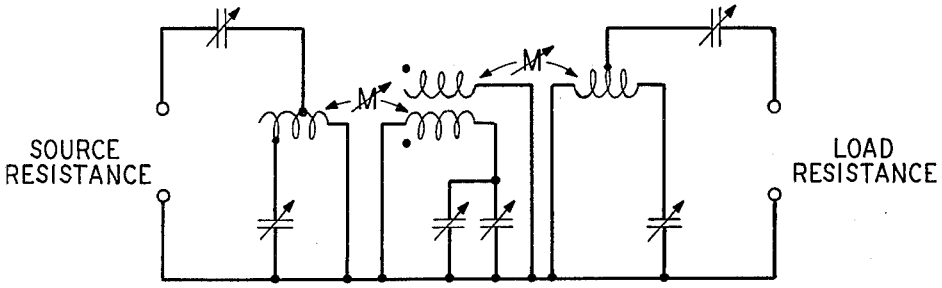
FIG. 5 shows another desirable type of equivalent circuit for a filter in the desired frequency range.

The equivalent circuit for the embodiment of FIG. 6 is shown in FIG. 5. It may be analyzed and described in the same conventional manner as the equivalent circuit of FIG. 4 except that capacitive coupling between resonators is not feasible in this particular arrangement.

Figure 7:
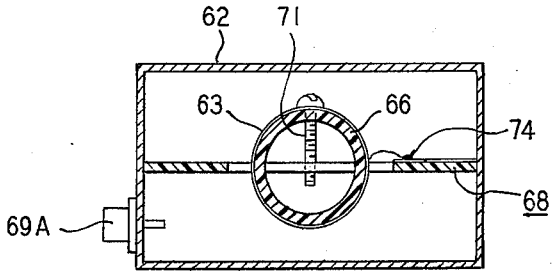
FIG. 7 is an assembly drawing of a helical resonator according to my invention shown in section.

The additional features which are noteworthy with respect to FIG. 6 relates to structural mounting details which includes coil forms 65 and 66. These coil forms are mounted on cards 67 and 68, the details of which may be appreciated as assembled in the convenient orthogonal views of FIGS. 6 and 7. The section of FIG. 7 is illustratively taken through the subassembly for the double winding helical conductor 63. But similar details may be used with the more conventional helical conductor 64. The coil form 66 in FIG. 7 is supported on the portions of the card 68 through which the screws 71 pass. Typically, the upper half of coil form 66 will extend over the end portions of card 68; but the lower half of the coil form 66 will fit therebetween. Of particular note in the assembly drawings of FIGS. 6 and 7 is the fact that the conductive connections to the shield 62 are made through metalized portions 72 of the card 68. Those metalized portions 72 extend to abut shield 62. In contrast, the free ends 73 and 74 of the two winding portions are connected to metalized portions on the card which are isolated from the shield connections 72. These connections of the ends 73 and 74 tend to give additional stability and support to the respective portions of coil 63.

Figure 8A:
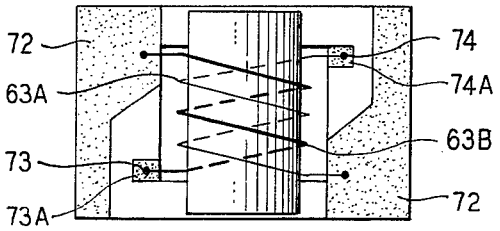
FIG. 8A is a pictorial plan view of the subassembly including double helix, coil form and mounting card.
Figure 8B:
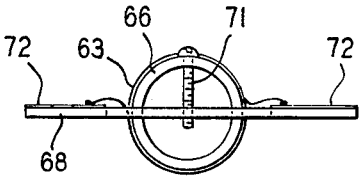
FIGS. 8B and 8C show end and side elevations of the subassembly of FIG. 8A.
Figure 8C:
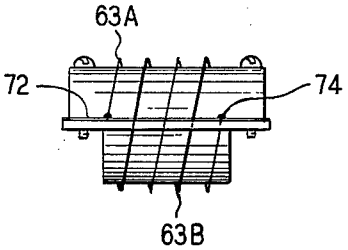
Figure 9A:
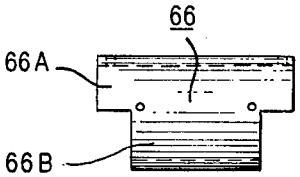
FIG. 9A shows the coil form pictorially in a side elevation.
Figure 9B:
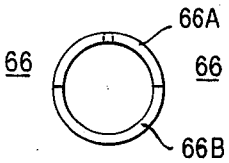
FIG. 9B is an end elevation of the coil form of FIG. 9A.
Figure 10:
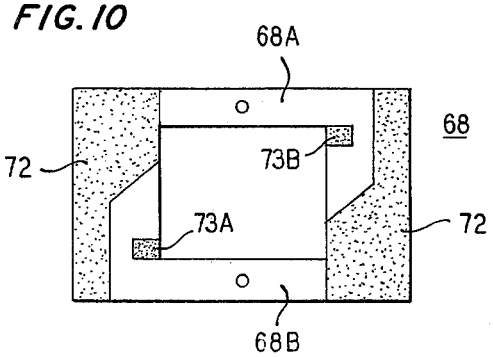
FIG. 10 shows pictorial details in a plan view of the card on which the coil form of FIGS. 9A and 9B is intended to be mounted.

These details may be seen more clearly from the subassembly sketches of FIGS. 8A, 8B and 8C in which the isolated metalized portions of the cards to which ends 73 and 74 are connected are labeled as 73A and 74A, respectively. Note also that, minimizing the inductance of the connections to the shield 62, the metalized portions 72 have their largest width extending from the shield in the vicinity of their connection to the respective opposed ends of the coil portions 63A and 63B, and are relatively narrower as they extend along the shield away from the helix connections. This particular shape leaves room for the isolated metalized connections 73A and 74A for coil ends 73 and 74. End view and side views of the plan view of FIG. 8A are shown in FIGS. 8B and 8C for the purposes of clarity.

the coil form 66 is shown by itself in two views in FIGS. 9A and 9B. In the side elevation of FIG. 9A it is seen that the lower part 66B of coil form 66 has less axial length than the upper part 66A, the ends of which must rest on the end portions 68A and 68B of card 68 as shown in FIG. 10. The end view of FIG. 9B shows that the aperture for screw 71 in coil form 66 is disclosed to be aligned with the holes in end portions 68A and 68B of the card 68.

It is believed that this particular assembly structure makes the double winding helical resonator especially adapted to be combined in composite resonator filters with more conventional helical resonators, which may then also use the same structural details.

It is believed that a given filter characteristic can in general be achieved with better quality and with fewer resonator elements using the new double winding helical resonator than was possible with the prior art single winding helical resonators. Therefore, new degrees of design freedom have been achieved.

What is claimed is:

1. A helical resonator of the type comprising a housing forming a conductive shield, a helical conductive coil having an end attached to a wall of said shield and an end within said shield, and means insulated from said shield for coupling from outside said shield to said coil, characterized in that said coil includes first and second helical portions having like pitches and interspersed turns, one pair of opposite ends of the two respective portions being connected to said shield.

2. A helical resonator of the type claimed in claim 1 in which the two helical portions have the same axis and same diameter.

3. A helical resonator of the type claimed in claim 1 including at least one additional helical resonator coupled to the conductive coil having first and second portions.

4. A helical resonator of the type claimed in claim 3 in which the helical conductive coil having first and second portions is coupled axially with the additional helical resonator.

5. A helical resonator of the type claimed in claim 1 including means for supporting the helical conductive coil within the cavity.

6. A helical resonator according to claim 5 in which the supporting means comprise conductive material extending from the one pair of opposite ends of the two respective portions to the conductive cavity.

7. A helical resonator according to claim 5 in which the supporting means comprise a dielectric coil form and a dielectric card supporting the coil form and being supported by at least one wall of the shield, said card having a plurality of metalized regions connected to the ends of said two portions of the double winding helical conductor, two of the metalized regions being connected to the one pair of opposite ends of the two respective portions and extending to contact the shield, the other two metalized regions being electrically isolated and connected to the other pair of opposite ends of the respective portions.

8. A helical resonator filter of the type including a plurality of coupled helical conductors, and a conductive shield in which said helical conductors are disposed to form at least one resonator, characterized by means for suppressing odd harmonics of the passband of the filter in that said helical conductors comprise at least one single winding helical conductor and coupled thereto at least one double winding helical conductor including first and second helical portions having like pitches and interspered turns, one pair of opposite ends of the two respective portions being connected to the conductive shield of the resonator.

9. A helical resonator filter of the type claimed in claim 8 in which the first and second portions of the double winding helical conductor have the same axis and the same diameter.

10. A helical resonator filter of the type claimed in claim 9 including a dielectric card defining a plane passing through the axis of the two portions of the double winding helical conductor, said card having a plurality of metalized regions connected to the ends of said two portions of the double winding helical conductor, two of the metalized regions being connected to the one pair of opposite ends of the two respective portions and extending to contact the conductive shield, the other two metalized regions being electrically isolated and connected to the other pair of opposite ends of the respective portions.

* * * * *